US007052554B2

(12) United States Patent
Rothenberger

(10) Patent No.: US 7,052,554 B2
(45) **Date of Patent: *May 30, 2006**

(54) SPRING SHAFT FOR PIPE CLEANING APPARATUS

(75) Inventor: Helmut Rothenberger, Königstein (DE)

(73) Assignee: Rothenberger Werkzeuge Aktiengesellschaft, Kelkheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 619 days.

(21) Appl. No.: 09/887,738

(22) Filed: Jun. 22, 2001

(65) Prior Publication Data

US 2002/0000015 A1 Jan. 3, 2002

(30) Foreign Application Priority Data

Jul. 1, 2000 (DE) ..... 100 32 144

(51) Int. Cl.
*B08B 9/027* (2006.01)

(52) U.S. Cl. ..... 134/6; 15/104.09; 15/104.16; 15/104.33

(58) Field of Classification Search ..... 15/104.03, 15/104.05, 104.09, 104.095, 104.16, 104.31, 15/104.33; 267/167; 134/6
See application file for complete search history.

(56) References Cited

U.S. PATENT DOCUMENTS

| | | | | |
|---|---|---|---|---|
| 2,090,174 | A | | 8/1937 | Albright |
| 2,114,236 | A | * | 4/1938 | Pellette |
| 2,739,368 | A | * | 3/1956 | McCall |
| 2,868,299 | A | * | 1/1959 | Gist |
| 2,880,435 | A | * | 4/1959 | Deutsch |
| 2,997,106 | A | * | 8/1961 | Tripplehorn |
| 3,011,775 | A | * | 12/1961 | MacCleod |
| 3,149,359 | A | * | 9/1964 | Hunt |
| 3,176,771 | A | * | 4/1965 | Claiborne |

FOREIGN PATENT DOCUMENTS

GB 974869 11/1964

* cited by examiner

*Primary Examiner*—Terrence R. Till
(74) *Attorney, Agent, or Firm*—Fulbright & Jaworski L.L.P.

(57) ABSTRACT

A spring shaft (1) for cleaning pipelines consists of a coil spring (2) with windings (3, 3*a*, 3*b*, 3*c*) of spring steel and with a rotation axis (RA) and a spiral winding axis (WA). In order to give the spring shaft (1) a particular cleaning function, the windings (3, 3*a*, 3*b*, 3*c*) have at least on their outside (4) a cross section departing from the circular shape, with at least one edge (K) acting on the pipeline. At the same time it is possible to provide the outside (4) with at least one longitudinal groove (8) following the windings (3*c*), or to configure the cross section of the windings (3*a*, 3*b*) as a square whose outside edge (4*a*) runs parallel to the rotation axis (RA) or whose surface diagonal (4*b*) runs radially to the rotation axis (RA). Lastly, it is possible to provide the outside (4) with a profile (5) in which projections and grooves alternate.

24 Claims, 2 Drawing Sheets

Figures 4A, 4B, 4C, 4D, 5:
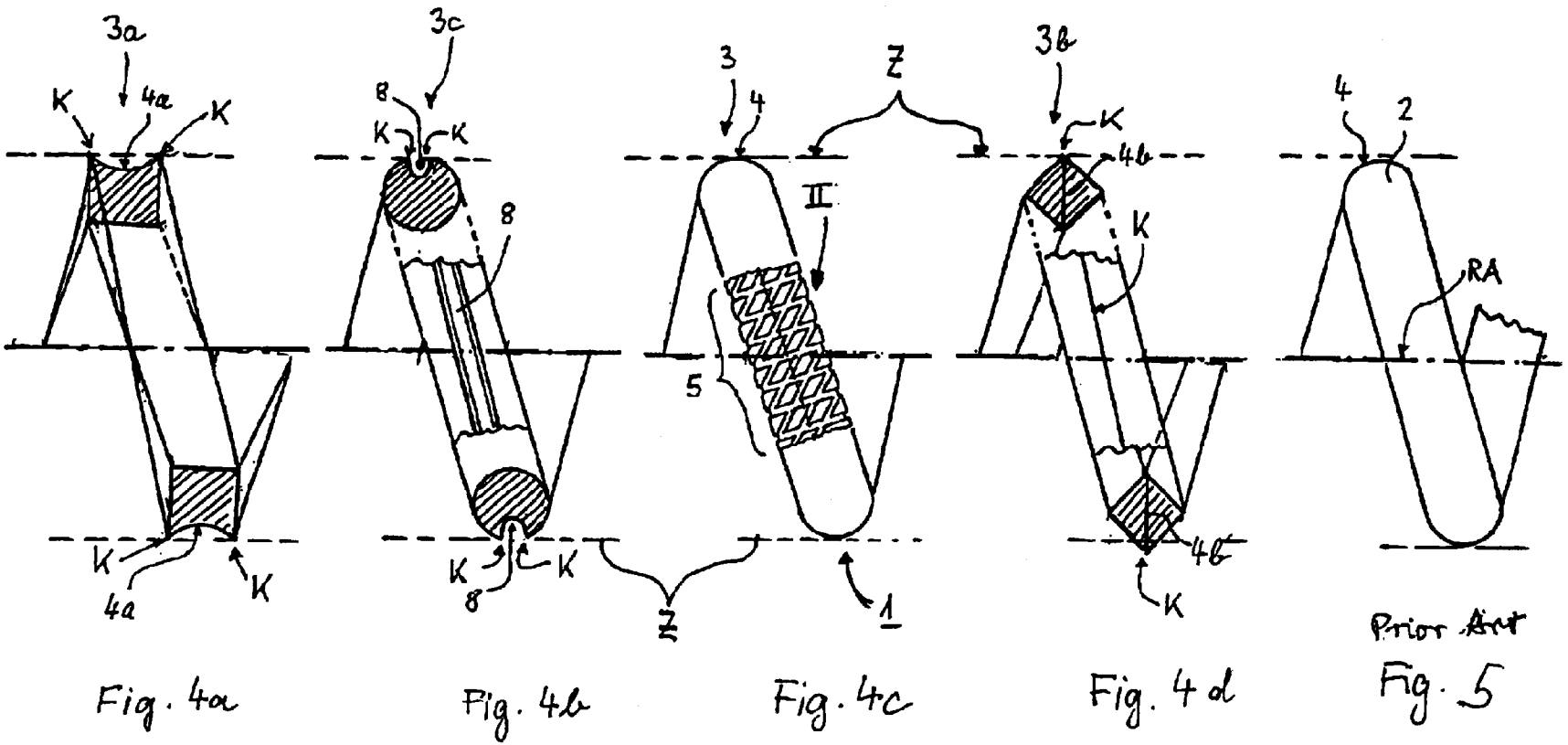
Fig. 4d Prior Art

FIG. 1
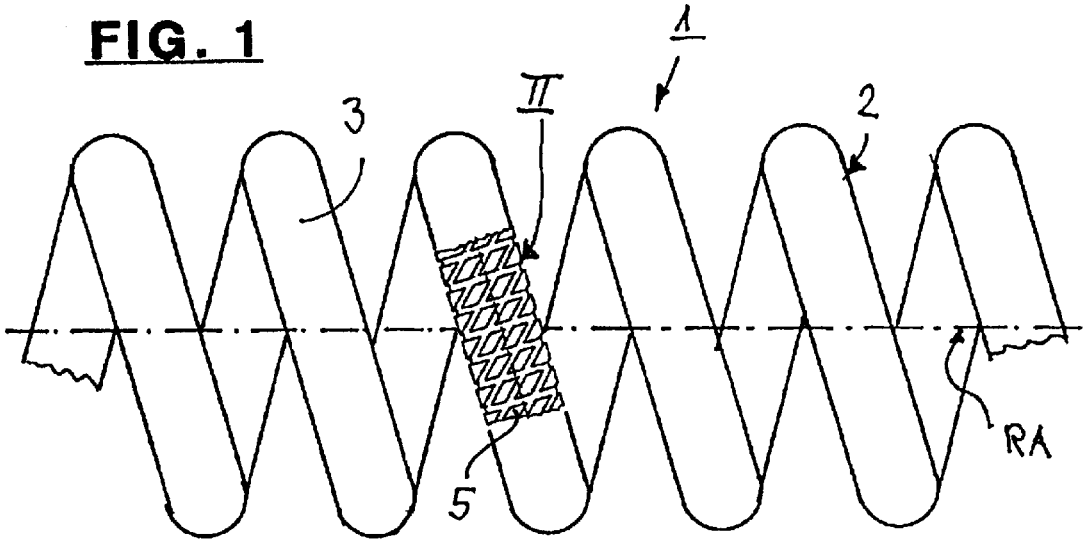
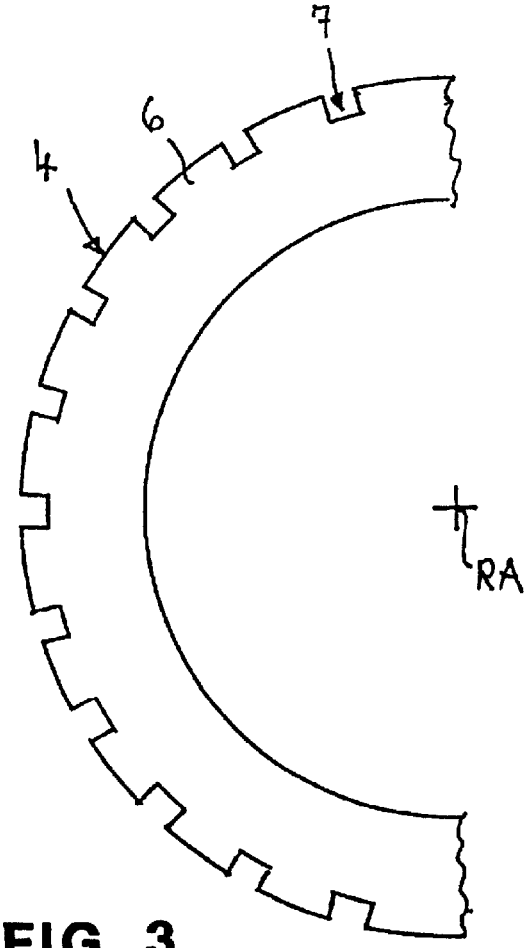
FIG. 3
FIG. 2
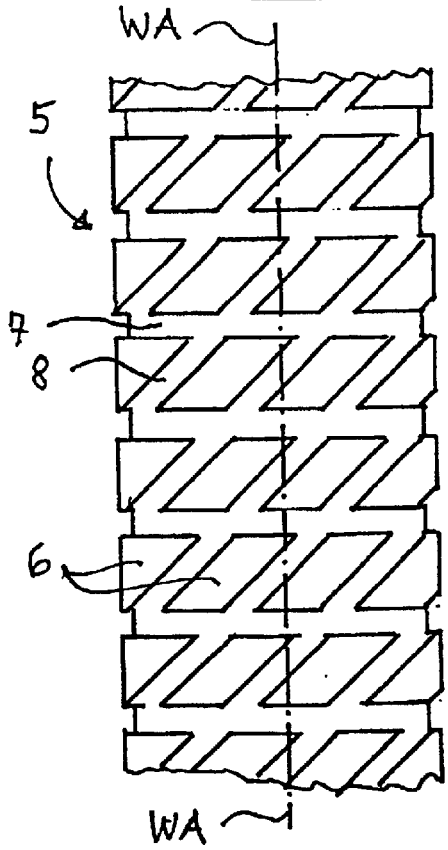

SPRING SHAFT FOR PIPE CLEANING APPARATUS

BACKGROUND AND SUMMARY OF THE INVENTION

The invention relates to a spring shaft for cleaning pipelines.

Such spring shafts, which are also called cleaning coils, consist usually of a coiled drawn steel wire of round cross section with a smooth surface. They are provided at their ends with couplings for connecting to a great variety of tools, such as drills, cutterheads, thrashing chain heads, pipe brushes, root cutters, mud drills, etc. The machines that drive them and their manner of operation are explained in the detailed description.

Such spring shafts, which are also called cleaning coils, consist usually of a coiled drawn steel wire of round cross section with a smooth surface. They are provided at their ends with couplings for connecting to a great variety of tools, such as drills, cutterheads, thrashing chain heads, pipe brushes, root cutters, mud drills, etc. The machines that drive them and their manner of operation are explained in the detailed description.

The known spring shafts are substantially of only a drive character. The mounted tools are inserted into clogged pipelines by the spring shaft, which can also be composed of several spring shafts, and "work their way" through elbows, branch lines etc. They are withdrawn by reversing their sense of rotation, and in the case of stubborn blockage they can also perform periodical forward and reverse movements.

DE 38 32 716 C2 discloses a spring shaft with a cross section in the shape of a rectangle or trapezoid, from which two opposite edges run parallel to the axis of the spring shaft. The outer edge of these helically running edges lies in an imaginary cylindrical surface if one considers the outstretched position of the spring shaft. Thus the corners of this cross section which also ran helically can exercise no cleaning action on the inner walls of pipes, even when the spring shaft is passed through bends or elbows because in these cases the outer edge of the cross section contacts the bend only tangentially on its smallest radius of curvature; in other words the cross sectional edges in the pipe bend cannot come in contact with the inside surface of the pipe.

The known apparatus serves for lining the inner walls of pipes, and at the end of the spring shaft a plurality of successive rotationally symmetrical spreader bodies are arranged for a fluid coating material which is fed through a hose running inside of the spring shaft, and is distributed on the pipe wall by the spreader bodies when the spring shaft is withdrawn. The spring shaft has only a driving function. For the sake of limiting changes in diameter when the spring shaft is rotated forward and backward, the latter has a rectangular or trapezoidal cross section defined by formulas. The use of the spring shaft itself as a cleaning device is neither disclosed nor suggested, since it is expressly stated that, for cleaning the pipe's inside wall, cleaning devices must be attached to the forward end of the spring shaft.

The invention is addressed to the problem of improving such spring shafts so that, while preserving their driving function itself, they can exercise a cleaning action.

The solution of the stated problem is accomplished according to the invention by the features in the specific part of claim 1.

The stated problem is solved to the full extent by this solution, i.e., while retaining their driving function itself, they exercise a cleaning action and scrape, so to speak, even stubborn incrustations from the pipe walls, which can consist of ceramics, cast iron or plastic.

It is especially advantageous, as a result of further embodiments of the invention, if, either individually or in combination:

- the exterior is provided with at least one longitudinal groove following the coils,
- the cross section of the coils is a square whose one surface diagonal run at least substantially radially to the axis of rotation,
- the exterior is provided with a profile in which projections and grooves alternate,
- the projections are sharp-edged at least in the circumferential direction of the coil axis,
- the projections are surrounded by the grooves,
- the grooves form two groups of which the grooves of the one group run substantially in the circumferential direction of the coil axis and the grooves of the other group run at an angle thereto,
- the grooves of both groups intersect at an angle between 30 and 60 degrees,
- the projections overlap in the circumferential direction of the coil axis such that drive jaws of a machine driving the spring shaft cannot drop into the grooves, and/or if
- the projections are rhomboidal in plan.

The shaping can be done by rolling, grinding or milling, also on the wire before winding, if desired. In this case heed must be paid only to precise guidance in the winding.

Embodiments of the invention are described below in conjunction with FIGS. 1 to 5.

FIG. 1 is a side view of a section of the length of a spring shaft of a first embodiment, FIG. 2 the section II from FIG. 1 on a larger scale, FIG. 3 a section through a half turn of the spring shaft of FIG. 1, also on a scale larger than in FIG. 1, FIGS. 4*a–d* various additional embodiments on a section of the length of a spring shaft on a scale larger than in FIG. 1, and FIG. 5 is a view of a spring shaft according to the prior art.

DETAILED DESCRIPTION

In FIGS. 1 to 3 there is shown a spring shaft 1 for a pipe cleaning apparatus not shown, which consists in a known manner of a portable or mobile driving machine having an electric motor and a clutch driven thereby. This clutch contains sector-shaped clutch jaws which can be urged radially against the spring shaft, the pressure applied determining the torque of the spring shaft.

The spring shaft 1 consists of a coil spring 2 of spring steel, with an axis of rotation RA and a plurality of windings 3 whose exterior 4 is provided with a profile 5 in which projections 6 and grooves 7 and 8 alternate, the spring shaft having a coupling 100 attached to an end for connection to a tool. The projections 6 are sharp-edged at least in the direction of the circumference of the winding axis (WA—WA). In this case the projections 6 are surrounded by the grooves 7 and 8. The profile 5 extends, of course, over the entire length of the spring shaft 1.

The grooves 7 and 8 form two sets, of which grooves 7 of the one set run substantially in the direction of the circumference of the winding axis (WA—WA) and grooves 8 of the other set run at an angle thereto, which is between 30 and 60 degrees. The arrangement is such that the projections 6 overlap in the direction of the circumference of the winding axis (WA—WA) such that clutch jaws of a machine driving the spring shaft cannot drop into grooves 8. For this purpose the projections 6 are rhomboidal in plan.

FIG. 4 shows various additional embodiments on a section of the length of a spring shaft 1. The two ends represent correspond to the state of the art with a cross section of circular shape. The outsides lie—as seen in the outstretched position—in an imaginary cylinder surface Z represented in broken lines.

The winding 3*a* consists of a wire with such a cross section (shown twice, hatched) that its external helical shaped surface 4*a* is concave, so that two sharp edges K, each with an angle of aperture of less than 90 degrees are formed, which enclose between them a circumferential groove. Thus two sharp edges K are formed, which act on the pipe walls and there scrape off incrustations.

The winding 3*b* consists of a wire with a square cross section (shown twice, hatched), of which the surface diagonal 4*b* runs radially to the axis of rotation RA. Thus a sharp edge K is formed which acts on the pipe walls and scrapes away incrustations. The square cross section can be square, rectangular, diamond-shaped or trapezoid, of which, in winding 3*a*, at least the outer edge 4*a* can also be concave to enhance the scraping action of the edges K.

The winding 3*c* consists of a wire with an originally circular cross section (shown twice, hatched), in whose exterior a groove 8 following windings 3*c* is created. Here again two sharp edges K are formed, which act on the pipe walls and scrape off incrustations.

Of course, the windings 3, 3*a*, 3*b* and 3*c* pertain to different spring shafts. Windings 3*a* to 3*c* produce in addition to the scraping action a "screw guidance" of the spring shaft at all points at which the spring shaft forcibly contacts the pipe wall, e.g., in elbows or junctions. The compression of the spring shaft by the force with which it is driven is then reduced, and the driving forces then develop in part "on the spot." The same applies to withdrawal force.

It is claimed:

1. An apparatus comprising a rotating coil spring forming a spring shaft rotated by drive jaws of a driving machine, said rotating coil spring shaft having a coupling at an end for connecting a tool selected from the group consisting of drills, cutterheads, thrashing chains heads, pipe brushes, root cutters and mud drills and having windings of spring steel forming said rotating coil spring shaft and having a rotation axis and a coiled winding axis, the windings having at least on their exterior a cross section different from the circular shape, wherein at least the exterior of the windings is profiled such that said spring shaft acts by rotation and a screw guidance in the pipe with at least one sharp edge scrapingly on contamination of the pipe walls.

2. Apparatus according to claim 1, wherein the exterior is provided with at least one longitudinal groove following the windings.

3. Apparatus according to claim 1, wherein the cross section of the windings is a square whose one surface diagonal runs at least substantially radially to the rotation axis.

4. Apparatus according to claim 1, wherein the exterior is provided with a profile in which projections and grooves alternate.

5. Apparatus according to claim 4, wherein the projections are sharp-edged at least in a circumferential direction of the winding axis.

6. Apparatus according to claim 4, wherein the projections are surrounded by the grooves.

7. Apparatus according to claim 4, wherein the grooves form two groups of which the grooves of the one group run substantially in the circumferential direction of the winding axis and the grooves of the other group at an angle thereto.

8. Apparatus according to claim 7, wherein the grooves of both groups cross one another at an angle between 30 and 60 degrees.

9. Apparatus according to claim 8, wherein the projections overlap one another in the circumferential direction of the winding axis such that drive jaws of a driving machine for the apparatus cannot drop into the grooves.

10. Apparatus according to claim 8, wherein the projections are of rhomboidal shape in plan.

11. A method of removing contamination on an inner pipe wall comprising inserting an apparatus into a pipe lumen having contamination on an inner pipe wall, said apparatus comprising a coil spring forming a spring shaft with windings of spring steel and with a rotation axis and a coiled winding axis, wherein the windings having at least on their exterior a cross section different from the circular shape and the exterior of the windings, and rotating said coil spring such that said spring shaft acts with at least one edge scrapingly with the inner pipe wall to remove contamination from the inner pipe wall.

12. The method of claim 11, wherein the exterior is provided with at least one longitudinal groove following the windings.

13. The method of claim 11, wherein the cross section of the windings is a square whose one surface diagonal runs at least substantially radially to the rotation axis.

14. The method of claim 11, wherein the exterior is provided with a profile in which projections and grooves alternate.

15. The method of claim 14, wherein the projections are sharp-edged at least in a circumferential direction of the winding axis.

16. The method of claim 14, wherein the projections are surrounded by the grooves.

17. The method of claim 14, wherein the grooves form two groups of which the grooves of the one group run substantially in the circumferential direction of the winding axis and the grooves of the other group at an angle thereto.

18. The method of claim 17, wherein the grooves of both groups cross one another at an angle between 30 and 60 degrees.

19. The method of claim 18, wherein the projections overlap one another in the circumferential direction of the winding axis such that drive jaws of a driving machine for the apparatus cannot drop into the grooves.

20. The method of claim 18, wherein the projections are of rhomboidal shape in plan.

21. A method of removing contamination on an inner pipe wall comprising inserting an apparatus of claim 1 into a pipe lumen having contamination on an inner pipe wall, said apparatus comprising a coil spring forming a spring shaft with windings of spring steel and with a rotation axis and a coiled winding axis, wherein the windings having at least on their exterior a cross section different from the circular shape and the exterior of the windings, and rotating said coil spring such that said spring shaft acts with at least one edge scrapingly with the inner pipe wall to remove contamination from the inner pipe wall.

22. The apparatus according to claim 11, wherein adjacent coils have a gap therebetween.

23. The method of claim 11, wherein the coils have a gap therebetween.

24. The method of claim 21, wherein the coils have a gap therebetween.

* * * * *